US005750491A

United States Patent [19]

DeBlock et al.

[11] Patent Number: 5,750,491

[45] Date of Patent: May 12, 1998

[54] SUPER CONCENTRATE EMULSIONS WITH FABRIC ACTIVES

[75] Inventors: Frans DeBlock, Merchtem; Jean-Francois Bodet, Brussels, both of Belgium

[73] Assignee: The Procter & Gamble Company, Cincinnati, Ohio

[21] Appl. No.: 592,385

[22] PCT Filed: Jul. 29, 1994

[86] PCT No.: PCT/US94/08593

§ 371 Date: Jun. 14, 1996

§ 102(e) Date: Jun. 14, 1996

[87] PCT Pub. No.: WO95/04184

PCT Pub. Date: Feb. 9, 1995

[30] Foreign Application Priority Data

Aug. 2, 1993 [EP] European Pat. Off. ..... 93202276

[51] Int. Cl.[6] ..... D06M 13/46; D06M 13/184

[52] U.S. Cl. ..... 510/521; 510/515; 510/522

[58] Field of Search ..... 510/515, 521, 510/522

[56] References Cited

U.S. PATENT DOCUMENTS

| | | | |
|---|---|---|---|
| 4,137,180 | 1/1979 | Naik et al. | 510/522 |
| 4,429,859 | 2/1984 | Steiner et al. | 510/524 |
| 4,767,547 | 8/1988 | Straathof et al. | 252/8.6 |
| 4,840,738 | 6/1989 | Hardy et al. | 510/524 |
| 5,246,695 | 9/1993 | Hintz et al. | 424/70.24 |
| 5,254,270 | 10/1993 | Birhan et al. | 510/522 |
| 5,254,271 | 10/1993 | Hamann et al. | 510/123 |

FOREIGN PATENT DOCUMENTS

| | | | |
|---|---|---|---|
| 40562 | 11/1981 | European Pat. Off. . | |
| 0 079 746 A2 | 5/1983 | European Pat. Off. | C11D 1/835 |
| 125103 | 11/1984 | European Pat. Off. . | |
| 305065 | 1/1989 | European Pat. Off. . | |
| 0 404 471 B1 | 12/1990 | European Pat. Off. | C11D 3/00 |
| 409502 | 1/1991 | European Pat. Off. . | |
| 417987 | 3/1991 | European Pat. Off. . | |
| 503155 | 9/1992 | European Pat. Off. . | |
| 0 507 478 A1 | 10/1992 | European Pat. Off. | C11D 1/835 |
| 507003 | 10/1992 | European Pat. Off. . | |

*Primary Examiner*—Anthony Green
*Attorney, Agent, or Firm*—Robert B. Aylor; T. David Reed

[57] ABSTRACT

The present invention relates to fabric softening compositions of insoluble, degradable cationic fabric softeners at high concentrations. In particular, the present invention addresses the problem of dispersibility which is usually associated with concentrations of biodegradable cationic fabric softeners above 30%. Including a mixture of aromatic acids, especially benzoic acid and salicylic acid, at an amount of at least 10% in total, has proven to eliminate the dispersibility drawbacks and stabilize the high concentration of the fabric softener active.

8 Claims, No Drawings

SUPER CONCENTRATE EMULSIONS WITH FABRIC ACTIVES

FIELD OF THE INVENTION

The present invention relates to fabric softening compositions of insoluble, degradable cationic fabric softeners at high concentrations. In particular, the present invention addresses the problem of dispersability which is usually associated with concentrations of bio-degradable cationic fabric softeners above 30%.

Including a mixture of aromatic acids, especially benzoic acid and salicylic acid, at an amount of at least 10% in total has proven to eliminate the dispersability drawbacks and stabilize the high concentration of the fabric softener active.

BACKGROUND OF THE INVENTION

Traditionally, high concentrations of fabric softener actives which have been described in the prior art and are available for consumers are not readily dilutable such that they cannot be used directly. In order to use them effectively in the dispenser of automatic washing machines they have to be pre-diluted with water under strong agitation. This step is seen more often than not to be unacceptable, leading to an upper limit of fabric softener active concentrations in order to simplify or eliminate this step.

Typically, the commercially available fabric softener active concentrations comprise less than 25% active. At concentrations above this the cationic fabric softener active would not easily dilute such that its direct use in the dispenser of automatic washing machines is not possible.

A possible, and, for those skilled in the art obvious solution to this problem of desired higher concentration and acceptable dispensing performance, would be to include high amounts of organic solvents allowing the, fabric softener active at concentrations even up to 50% to be easily dispersable. However, high amounts (i.e. more than 10% to 20%) of organic solvents in household chemicals have safety (flash point) environmental and severe regulatory drawbacks (in some countries) and are therefore questionable in a household chemical.

The problem of dispersing and stability of the composition is further aggravated when fabric softeners containing at least one ester link to improve their bio-degradability are introduced.

Therefore, the problem underlying the present invention is to provide bio-degradable cationic fabric softeners at concentrations of at least 30% without the use of high amounts (more than 10 to 20%) of organic solvents and having a desirable i.e. sufficiently complete dispersing from the dispersing compartment of typical automatic washing machines.

EP-A-40562 discloses concentrated quaternary ammonium compounds in combination with non-ionic emulsifier to form a viscous gel of high concentration. This gel is not useful in dispersers of washing machines.

EP-A-79746 discloses traditional cationic fabric softeners which are non-biodegradable at high concentrations in combination with organic solvents particularly alcohols. The compositions are said to have good cold water dispersability in domestic automatic washing machines.

EP-A-507478 relates to bio-degradable fabric softeners preferably at concentrations between 8 and 15%, in combination with iso-propyl-alcohol.

GP-4333667 discloses degradable fabric softener compounds of high unsaturation levels in combination with polyvalent cyclic acids. However, no disclosure of the compositions according to the present invention and the problem underlying it are mentioned.

The closest prior art is considered to be EP-A-125103 mentioning highly concentrated traditional cationic fabric softeners in combination with aromatic acids. The fabric softeners are said to have good storage stability and cold water dispersability. Benzoic acid and salicylic acid are mentioned however no combination of aromatic acids, i.e. no mixture of aromatic acids are disclosed. Further this patent disclosure does not address the additional stability problems found in bio-degradable fabric softeners which is due to their ester link as the molecular site of initial decomposition in the environment.

EP-A-503155 and EP-A-507003 discloses di-ammonium compounds and poly-amino-esters which are both highly preferred additional compounds in the present invention however only in combination with a bio-degradable fabric softener and the aromatic acid mixture.

An additional problem underlying the present invention is the desire to provide the highly concentrated fabric softening composition as a clear isotropic composition. This is also solved by the incorporation of the aromatic acid mixture at high concentrations of the bio-degradable fabric softener active.

EP-A-305065 discloses isotropic fabric softening compositions having a quaternary ammonium of high iodine value to promote the isotropic appearance. EP-A-404471 contains high amounts of bio-degradable cationic fabric softening in combination with at least 5% inorganic acid to promote isotropic appearance. Neither of these disclosures mentions or hints towards the dispersability at concentrations above 30% of the bio-degradable fabric softener compound in combination with mixtures of aromatic acids.

SUMMARY OF THE INVENTION

The present invention relates to concentrated fabric treatment compositions comprising a fabric softening compound having at least one lipophilic hydrocarbonrest connected by an ester link to a quaternized nitrogen, i.e. a bio-degradable compound.

The composition further contains, as a key compound, an aromatic acid mixture which comprises a poly substituted aromatic acid. The fabric treatment composition comprises at least 30% by weight, preferably at least 40% by weight in total of cationic fabric softening compounds.

In a particularly preferred embodiment of the present invention the concentrated fabric treatment composition is characterized in that is comprises

- 25% to 60% by weight of quaternized ester ammonium fabric softener compounds;
- 10% to 25% by weight of quaternized ester di-ammonium fabric softener compound;
- 1% to 15% by weight benzoic acid; and
- 1% to 15% by weight salicylic acid.

Further the present invention also pertains to the use of an aromatic acid mixture in a concentrated fabric treatment composition for dispersing the fabric treatment composition in washing machine dispersers, such that

- the aromatic acid mixture comprises a poly substituted aromatic acid;
- the fabric treatment composition comprises a fabric softening compound with at least one lipophilic hydrocarbonrest connected by one ester link to a quaternized nitrogen; and the composition contains at least 30% of a cationic fabric softening compound.

DETAILED DESCRIPTION OF THE INVENTION

In the following the essential compounds and optional compounds of the invention will be described separately. Percentages, when they are indicated, are by weight of the final composition. For optional compounds, reference is made here to the general knowledge of those skilled in the art and the prior art documents mentioned herein.

The Bio-Degradable Fabric Softening Compound

The essential fabric softening compound of the present invention is typically a non-soluble ester quaternized ammonium, preferably a di-ester quaternary ammonium. These compounds are present in combination with all other (inclusive original) cationic fabric softening compounds in a total amount of at least 30%, preferably at least 40%. Preferably they are present at an amount of 25% to 60% better yet about 30% to 50% not accounting for optional cationic fabric softeners.

According to the-present invention the ammonium can have the general formula:

$$(R)_{4-m}—N+—[(CH_2)n—Y—R^2]m\ X^-$$

wherein each Y=—O—(O)C—, or —C(O)—O—;

m=1, 2 or 3, preferably 2;

each n=1 to 4 each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof; each $R^2$ is a long chain $C_{12}$–$C_{22}$ hydrocarbyl, or substituted hydrocarbyl substituent, preferably $C_{15}$–$C_{19}$ alkyl and/or alkylene, most preferably $C_{15}$–$C_{17}$ straight chain alkyl and/or alkylene; and the counterion, $X^-$, can be any softener-compatible anion, for example, chloride, bromide, methylsulfate, formate, sulfate, nitrate, and the like.

It will be understood that substituents R and $R^2$ can optionally be substituted with various groups such as alkoxyl or hydroxyl groups, and/or can be saturated, unsaturated, straight and/or branched so long as the $R^2$ groups maintain their basically lipophilic character. The preferred compounds can be considered to be di-ester variations of ditallow dimethyl ammonium chloride (DTDMAC), which is a widely used fabric softener. At least 80% is in the di-ester form, and from 0 % to about 20% can be monoester.

As used herein when the di-ester is specified, it will include the monoester that is normally present, but not additional monoester that is added. For softening, the percentage of di-ester should be as high as possible, preferably more than 90%.

The above compounds used as the primary active softener ingredient in the practice of this invention can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^2C(O)Cl$, then quaternized with an alkyl halide, RX, to yield the desired reaction product (wherein R and $R^2$ are as defined herinbefore). The following are non-limiting examples (wherein all long-chain alkyl substituents are straight-chain):

$$[HO—CH(CH_3)CH_2][CH_3]N^+[CH_2CH_2OC(O)C_{15}H_{31}]_2\quad Br^-$$

$$[C_2H_5]_2N^+[CH_2CH_2OC(O)C_{17}H_{35}]_2\quad Cl^-$$

$$[CH_3][C_2H_5]N^+[CH_2CH_2OC(O)C_{13}H_{27}]_2\quad I^-$$

$$[C_3H_7][C_2H_5]N^+[CH_2CH_2OC(O)C_{15}H_{31}]_2\quad (SO_4—CH_3)^-$$

$$[CH_3]_2N^+—CH_2CH_2OC(O)C_{15}H_{31}\quad Cl^-$$
$$\quad\quad \backslash$$
$$\quad\quad CH_2CH_2OC(O)C_{17}H_{35}$$

$$[CH_2CH_2OH][CH_3]N^+[CH_2CH_2OC(O)R^2]_2\quad Cl^-$$

$$[CH_3]_2N^+[CH_2CH_2OC(O)R^2]\quad Cl^-$$

where —C(O)R2 is derived from soft or hard tallow, or mixtures thereof.

Since the foregoing compounds (di-esters) are somewhat labile to hydrolysis (hence their beneficial degradability), they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. pH ranges for making stable softener compositions containing di-ester quaternary ammonium fabric softening compounds are disclosed in U.S. Pat. No. 4,767,547.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric and phosphoric acids. The presence of the aromatic acids which are essential to the present invention also helps to stabilize the di-ester compounds.

The di-ester qua-ternary ammonium fabric softening compound (DEQA) can also have the general formula:

$$\begin{matrix} R^2C(O)OCH_2 \\ \quad\quad\quad\quad\rangle CHCH_2N^+R_3\quad X^- \\ RC(O)O \end{matrix}$$

wherein each R, $R^2$ and X have the same meanings as before. Such compounds include those having the formula:

$$[CH_3]_3N^+[CH_2CH(CH_2OC(O)R^2)OC(O)R^2]\quad Cl^-$$

where —OC(O)R2 is derived from soft or hard tallow, or mixtures thereof.

Preferably each R is a methyl or ethyl group and preferably each $R^2$ is in the range of $C_{15}$ to $C_{19}$. Degrees of branching, substitution and/or non-saturation can be present in the alkyl chains. The anion $X^-$ in the molecule is preferably the anion of a strong acid and can be, for example, chloride, bromide, iodide, sulphate and methyl sulphate; the anion can carry a double charge in which case $X^-$ represents half a group. These compounds, in general, are more difficult to formulate as stable concentrated liquid compositions. These types of compounds and general methods of making them are disclosed in U.S. Pat. No. 4,137,180.

For stability of the composition and to enhance concentratability, as well as the derived isotropic characteristic, it is beneficial to have a high level of unsaturation in the lipophilic long chain hydrocarbons. An iodine value of above 30 up to 100, preferably above 50, has been found to be beneficial. Also beneficial, particularly if the iodine value is not above 70, are double bonds of the cis configuration due to their melting point difference vs trans double bonds.

As an optional viscosity modifier single long chain cationic surfactants, which are water soluble, can be present in amounts of 0% up to 15%. Such single long-chain-alkyl surfactants useful in the present invention are, preferably quaternary ammonium salts of the general formula:

$$[R^2N^+R_3]\ X^-$$

wherein the $R^2$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g. a fatty acid ester of choline, preferably $C_{12}$–$C_{14}$ (coco) choline ester and/or $C_{16}$–$C_{18}$ tallow choline ester. Each R is a $C_1$–$C_4$ alkyl or substituted (e.g. hydroxy) alkyl, or hydrogen, preferably methyl, and the counterion $X^-$ is a softener compatible anion, for example, chloride, bromide, methyl sulfate, etc.

The ranges above represent the amount of the water soluble single-long-chain-alkyl cationic surfactant which is added to the composition of the present invention. The ranges do not include the amount of monoester which is already present in the essential fabric softening compound.

The long chain group $R^2$, of the single-long-chain-alkyl cationic surfactant, typically contains an alkylene group having from about 10 to about 22 carbon atoms, preferably from about 12 to about 18 carbon atoms. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage between the nitrogen and the long chain are described in U.S. Pat. No. 4,840,738.

It will be understood that the main function of the water-soluble cationic surfactant is to lower the viscosity and/or increase the dispersibility of the essential fabric softener compound and it is not therefore, essential that the cationic surfactant itself have substantial softening properties, although this may be the case. Also, surfactants having only a single long alkyl chain, presumably because they have greater solubility in water, can protect the essential fabric softener compound from interacting with anionic surfactants and/or detergent builders that are carried over into the rinse.

Other optional cationic materials with ring structures such as alkyl imidazoline, imidazolinium, pyridine, and pyridinium salts having a single $C_{12}$–$C_{30}$ alkyl chain can also be used. Very low pH is required to stabilize, e.g. imidazoline ring structures.

Some alkyl imidazolinium salts useful in the present invention have the general formula:

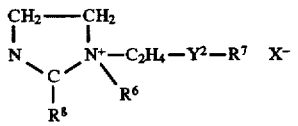

wherein $Y^2$ is —C(O)—O—, —O—(O)—C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selcted from R and $R^2$ as defined hereinbefore for the single-chain cationic surfactant with only one being $R^2$.

Some alkyl pyridiniun salts useful in the present invention have the general formula:

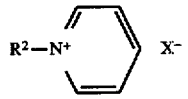

wherein $R^2$ and $X^-$ are as defined above. A typical material of this type is cetyl pyridinium chloride.

Further optional cationic and other softening compounds have been described or referred to in PCT application US-93-04107 filed May 3, 1993.

Another optional compound improving the viscosity of highly concentrated fabric softening compositions are non-ionic surfactants. Suitable non-ionic surfactants to serve as viscosity/dispersibility modifier include addition products of ethylene oxide and, optionally, propylene oxide, with fatty alcohols, fatty acids, fatty amines, etc.

Any of the alkoxylated materials of the particular type described hereinafter can be used as the non-ionic surfactant. The non-ionics are used at a level of from 0% to about 15%. Suitable compounds are substantially water-soluble surfactants of the general formula:

$$R^9—Y—(C_2H_4O)_z—C_2H_4OH$$

wherein $R^9$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to about 20, preferably from about 10 to about 18 carbon atoms. More preferably the hydrocarbyl chain length is from 16 to 18 carbon atoms. In the general formula for the ethoxylated non-ionic surfactants herein, Y is typically —O—, —C(O)O—, —C(O)N(R)—, or —C(O)N($R^9$)R—, in which $R^9$, and R, when present, have the meanings given hereinbefore, and/or R can be hydrogen, and z is at least about 8, preferably at least about 10–11. Performance and, usually, stability of the softener composition decrease when fewer ethoxylate groups are present.

Examples of non-ionic surfactants are disclosed in further detail in PCT application US-93-04107 filed May 3, 1993.

The fabric softener compositions according to the present invention preferably further contain quaternary—di or poly—ammoniums as described in detail in EP-A-503155 and EP-A-507003. These ammoniums are referred to hereinafter as "QDA".

QDA are preferred since they have been found to allow even higher softener concentrations while further improving or at least stabilizing the dispersibility and clear appearance of the composition. QDA's are used in amounts of up to 25% preferably from 10% to 25%. All of the typical fabric softener compounds usual in the art may further be present in the compositions according to the present invention.

The Aromatic Acid Mixture

The second essential compound of the present invention is the mixture of aromatic acids. It is important to have a mixture of aromatic acids since one alone, in particular benzoic acid alone, has been found not to improve dispersibility at high concentrations of fabric softening compositions as desired. Aromatic acids are well known in the art and include specifically and preferably benzoic acid and its substituted derivates.

The aromatic acid herein is characterized by one or more nuclear or side-chain acidic, hydroxylic or aldehydic substituents. In the case of side chain substituents, the acid, hydroxyl or aldehyde group is attached at a point no more than eight, preferably no more than four carbon atoms from the aromatic nucleus. Aromatic adjuncts wherein the substituent groups are ($C_1$–$C_6$)-alkyl, -alkenyl, -aryl or alkaryl derivatives of the above acidic, hydroxylic and aldehydic groups are also envisaged, such adjuncts being formally esters, ethers or ketones. The alkyl, alkenyl, aryl or alkaryl groups are optionally further substitued with atoms or radicals other than the essential substituent groups named above, for example, by halogen atoms. In particular, acidic substituents are preferably present as free acid rather than in salt form.

A preferred class of aromatic acids have the general formula (II)

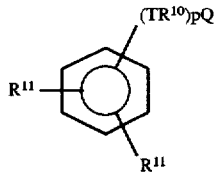

(II)

wherein Q is $OR^4$, $CO_2R^4$, $SO_3R^4$, or $(CO)R^4$, T is O,NH or a direct bond, $R^{10}$ is $C_{1-2}$ alkylene or alkenylene, p is from 0 to 4, preferably from 0 to 2, $R^4$ is H or $C_1$–$C_6$ alkyl, alkenyl, aryl or alkaryl, and wherein each $R^{11}$ is independently selected from $TR^{10})_pQ$ such that at least one carboxylic acid group is linked within a maximum of 4 carbon atoms to the aromatic nuclears.

The most preferred mixtures are those of benzoic acids and salicylic acid or para-hydroxy-benzoic-acid. The amount of the aromatic acid mixture naturally depends on the total amount of fabric softening compound and typically is from 5% to 30%, preferably from 10% to 25%. A weight ratio of unsubstituted benzoic acid to the sun of all substituted benzoic acids of 0:100 to 75:25, preferably 25:75 to 50:50, especially if the substituted benzoic acid is salicylic acid or para-hydroxy-benzoic-acid then the ratio should be from 40:60 to 60:40.

EXAMPLES

To evaluate the dispersibility of the present invention 4 formulations were prepared and analyzed fresh and after one week storage at 21° C., in the dispenser of an automatic washing machine and upon normal dilution with water. They were visually analysed for their dispersing quality and pictures taken. Also isotropic transparence after cold storage (at 5° C. for one week) was evaluated.

Compositions 1–3 were in accordance with the present invention while composition 4 differed only in the aromatic acid by not being a mixture. Hence Composition 4 was closer than the closest prior art to the present invention.

| Compositions | 1 | 2 | 3 | 4 |
|---|---|---|---|---|
| Dioleyl-DEEDMAC*,iodine value = 90 | 25% | 50% | — | 50% |
| Di(soft tallow)-DEEDMAC*, iodine value = 60 | — | — | 25% | — |
| DQA** | 25% | — | 25% | — |
| Poly glycerol mono oleate | 8.5% | 8.5% | 8.5% | 8.5% |
| Diethylene glycol mono butyl ether | 8% | 8% | 8% | 8% |
| Plenyl ethyl alcohol | 2% | 2% | 2% | 2% |
| Benzoic acid | 10% | 10% | 10% | 15% |

-continued

| Compositions | 1 | 2 | 3 | 4 |
|---|---|---|---|---|
| Salicylic acid | 5% | 5% | 5% | — |
| Minors (dye,perfume,etc.) and water | balance to 100% | balance to 100% | balance to 100% | balance to 100% |
| Test Results | | | | |
| dispersability in machine | excellent | good | excellent | poor |
| dilution with water (gel formation) | no gel | no gel | no gel | forms gel |
| isotropic (clearness) after 1 week at 5° C. | clear | clear | opaque | clear |

*Di-(tallow oyloxy ethyl)-dimethyl-ammonium-chloride, iodine value = 60
**available from REWO Chemische Werke GmbH, Steinau, Germany under Rewo-2957

USE OF THE PRESENT INVENTION

Use of an aromatic acid mixture in a concentrated fabric treatment composition for dispersing the fabric treatment composition in washing machine dispensers, such that said aromatic acid mixture comprises a poly substituted aromatic acid;

said fabric treatment composition comprises a fabric softening compound having at least one lipophilic hydrocarbon rest connected by an ester link to a quaternized nitrogen; and said fabric treatment composition comprising at least 30% by weight in total of cationic fabric softening compounds.

The use as mentioned above further characterized in that the aromatic acid mixture comprises 1% to 15% by weight of the treatment composition of benzoic acid and 1% to 15% by weight of the treatment composition of salicylic acid.

The use as indicated above but limited in that said fabric softening compound comprises 25% to 60% by weight of the treatment composition of a di(tallow ester) dimethyl ammonium and 10% to 25% by weight of the treatment composition of quaternized ester di-ammonium.

What is claimed is:

1. Concentrated, non gelling, easily dispersible fabric treatment composition comprising:

a) a fabric softening compound having the formula:

$$(R)_{4-m}—N+—[(CH2)_n—Y—R^2]\ X^-$$

wherein each Y=—O—(O)C—, or —C(O)—O—; m=1, 2 or 3; each n=1 to 4; each R substituent is a short chain $C_1$–$C_6$ alkyl or hydroxyalkyl group, benzyl or mixtures thereof: each $R^2$ is a long chain $C_{12}$–$C_{22}$ hydrocarbyl, or substituted hydrocarbyl substituent; and the counterion, $X^-$, is any softener-compatible anion; and b) an aromatic acid mixture comprising benzoic acid and a substituted aromatic acid selected from the group consisting of salicylic acid, para hydroxy benzoic acid and mixtures thereof, said fabric treatment composition comprising at least 30% by weight in total of cationic fabric softening compounds, including a).

2. The concentrated fabric treatment composition according to claim 1 wherein said fabric softening compound a) has an iodine value of 30 to 100.

3. The concentrated fabric treatment composition according to claim 1 wherein the composition further comprises a quaternized poly-ammonium.

4. The concentrated fabric treatment composition according to claim 1 wherein the fabric softening compound a) is present from 25% to 60% by weight of the composition;

a quaternized ester di-ammonium is present from 10% to 25% by weight of the composition;

benzoic acid is present from 1% to 15% by weight of the composition; and salicylic acid is present from 1% to 15% by weight of the composition.

5. The concentrated fabric treatment composition according to claim 1 wherein said fabric softening compound a) has an iodine value of 30 to 100.

6. The concentrated fabric treatment composition according to claim 1 wherein the composition further comprises a quaternized poly-ammonium.

7. The concentrated fabric treatment composition according to claim 2 wherein the composition further comprises a quaternized poly-ammonium.

8. The concentrated fabric treatment composition according to claim 2 wherein the fabric softening compound a) is present from 25% to 60% by weight of the composition;

a quaternized ester di-ammonium is present from 10% to 25% by weight of the composition;

benzoic acid is present from 1% to 15% by weight of the composition; and salicylic acid is present from 1% to 15% by weight of the composition.

* * * * *